7-145 S?
10/15/85 OP 4,546,510

United States Patent [19]

Harrison

[11] Patent Number: 4,546,510

[45] Date of Patent: Oct. 15, 1985

[54] HANDTOOL

[76] Inventor: Dan W. Harrison, Rte. 1, Box 570, Brownsboro, Tex. 75756

[21] Appl. No.: 446,780

[22] Filed: Dec. 3, 1982

[51] Int. Cl.[4] ..... B25F 1/00; B25G 1/06; B25G 1/08

[52] U.S. Cl. ..... 7/145; 30/151

[58] Field of Search ..... 7/145, 144, 143; 30/151, 153

[56] References Cited

U.S. PATENT DOCUMENTS

| | | | |
|---|---|---|---|
| 83,499 | 10/1868 | Holtzscheiter . | |
| D. 270,655 | 9/1983 | Collins . | |
| 440,905 | 11/1890 | Steinecke . | |
| 980,786 | 1/1911 | Humphries . | |
| 1,176,192 | 3/1916 | Beckton et al. . | |
| 1,185,250 | 5/1916 | Seelye . | |
| 2,018,603 | 10/1935 | Case et al. . | |
| 2,280,463 | 4/1942 | Williamson . | |
| 2,559,689 | 7/1951 | Truesdell . | |
| 2,721,340 | 10/1955 | Schultz . | |
| 2,820,291 | 1/1958 | Philippar | 30/153 |
| 3,321,783 | 5/1967 | Ivan . | |
| 3,581,326 | 5/1969 | Hayes . | |

*Primary Examiner*—Roscoe V. Parker
*Attorney, Agent, or Firm*—Arnold, White & Durkee

[57] ABSTRACT

There is provided an improved hand tool having a body portion with an axe blade attached thereto. A knife blade extends from the body portion and a sheath is pivotally mounted on the body portion so as to be movable between first and second positions. The sheath is configured to cover the knife blade when the sheath is in the first position and to cover the axe blade when the sheath is in the second position.

20 Claims, 3 Drawing Figures

HANDTOOL

BACKGROUND OF THE INVENTION

The invention relates to an improved handtool and more particularly to a handtool having an axe blade and a knife blade which are alternately covered by a pivotally mounted sheath or cover.

The patent literature discloses a variety of tools usable as axes, hammers, knives or some combination thereof. For example, Williamson, U.S. Pat. No. 2,280,463 discloses a combination tool having an axe head and a knife having a pair of opposed side cheek plates swingably mounted on a pivot to sheath the blade and provide a hand grip for the helve of the axe head. Hayes, U.S. Pat. No. 3,581,326 discloses an underwater utility tool including a knife blade and a pick having a head portion. A handle assembly is provided to slide along the knife blade to the pick or hammer portion, thus alternately providing cover for each.

A variety of other tools usable as axes, hammers, knives or the like are disclosed in a number of U.S. patents, including Ivan, U.S. Pat. No. 3,321,783; Holtzscheiter, U.S. Pat. No. 83,499; Steinecke, U.S. Pat. No. 440,990; Truesdell, U.S. Pat. No. 2,559,689 as well as others. These and other devices suffer from one or more of several disadvantages or limiations. For example, many of the tools have detachable segments which must be removed or detached prior to changing the use of the tool. Other devices fail to provide a cover or sheath for one of the working blades, such as an axe head. Still other devices have a considerable number of moving parts or hinged portions which result in segments of reduced strength thus limiting the durability of the tool.

These and other limitations and disadvantages are substantially reduced if not eliminated by the present invention.

SUMMARY OF THE INVENTION

Generally, there is provided a handtool having a body portion with an axe blade attached thereto. A knife blade extends from the body portion and a cover is pivotally mounted on the body portion so as to be movable between first and second positions. The cover is configured to cover the knife blade when the cover is in the first position and to cover the axe blade when the cover is in the second position.

More particularly, there is provided an improved handtool having a body portion, an axe formation, a knife formation and a pivotally mounted cover. The body portion has a cutting surface along one periphery. The cutting surface constitutes an axe blade formation. An elongated knife formation extends out of the body portion and has at least one sharpened edge. A cover is pivotally mounted on the body portion so as to be movable between first and second positions. The cover is configured to cover the sharpened edge of the knife formation when the cover is in the first position and the cutting surface of the axe formation when the cover is in the second position.

In one embodiment the cover is pivotally mounted at a point near the juncture of the body portion of the knife formation. The cover may be an elongated body with a first recess configured to cover the sharpened edge of the knife formation when the cover is in the first position and a second recess opposite the first recess. The second recess is configured to cover the cutting surface of the axe formation when the cover is in the second position. The axe formation preferably has a contoured extension configured to provide a smooth transition extension into the sharpened edge of the knife formation.

The body portion may be equipped with a plurality of finger grips. The cover may be equipped with a plurality of arcuate surfaces along one edge such that the arcuate surfaces are alignable with the finger grips when the cover is in the second position covering the axe formation cutting surface. The handtool may also be equipped with locks for alternately locking the cover in the first and second positions. Guards or internal stops may also be provided to aid in securing either the sharpened edge of the knife formation or the cutting edge of the axe blade formation. The knife formation may be equipped with a false edge.

A hammer formation may also be provided. The hammer formation may extend from the body portion at a point substantially opposite the axe formation. The hammer formation may also serve as a handle. To this end the hammer formation may include a neck portion extending out from the body portion opposite the axe formation and a head portion attached to the neck portion. The head portion is broader than the neck formation, thus allowing the hammer formation to serve as a handle.

In a more detailed embodiment there is provided a handtool including a body portion having an axe blade attached thereto. The working edge of the axe blade is a shallow arc with respect to the longitudinal axis of the body portion and extends a relatively short distance from the body portion. A knife blade extends from the body portion substantially along the longitudinal axis of the body portion. The knife blade is equipped with a cutting edge on one side and a false edge on the other. A cover is pivotally mounted on the body portion at a point near the juncture of the knife blade and the axe blade so as to be movable between first and second locking positions. The cover has a first recess for covering the cutting edge of the knife blade when the cover is in the first position. There is also provided a second recess in the cover for covering the working edge of the axe blade when it is in the second position. Finger holes may be provided and the cover may be contoured to align with the finger holes when the cover is in the second position.

There will now be provided a detailed description of an embodiment of the present invention in conjunction with the present drawings. This detailed description is made for purposes of illustration and not by way of limitation.

DETAILED DESCRIPTION

Figure 1:
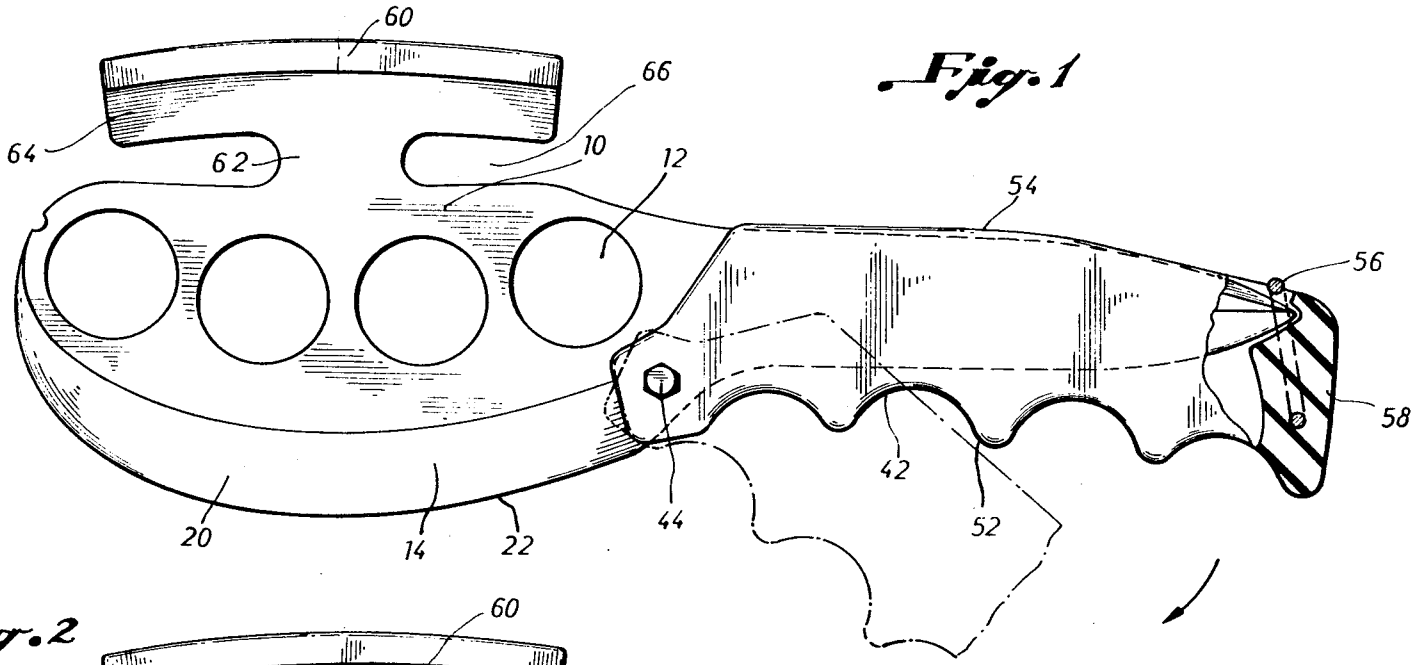
FIG. 1 is a side schematic view of one embodiment of the present invention.
Figure 2:
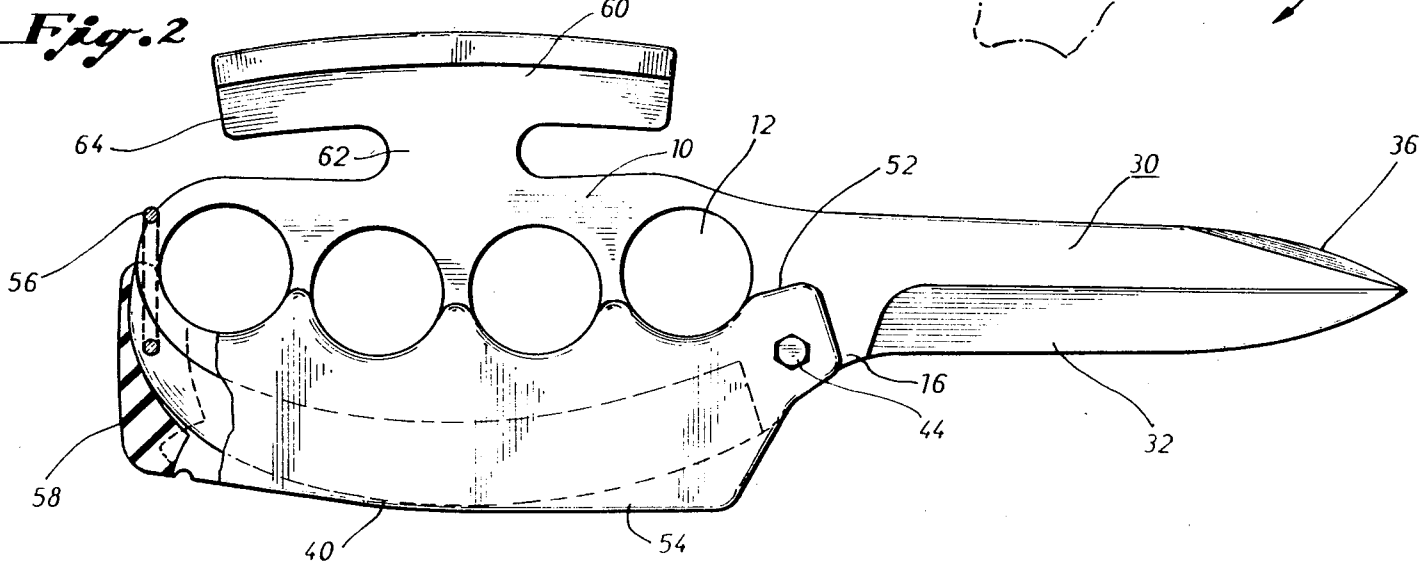
FIG. 2 is a side schematic view of the embodiment shown in FIG. 1 with the cover pivoted into a different position.
Figure 3:
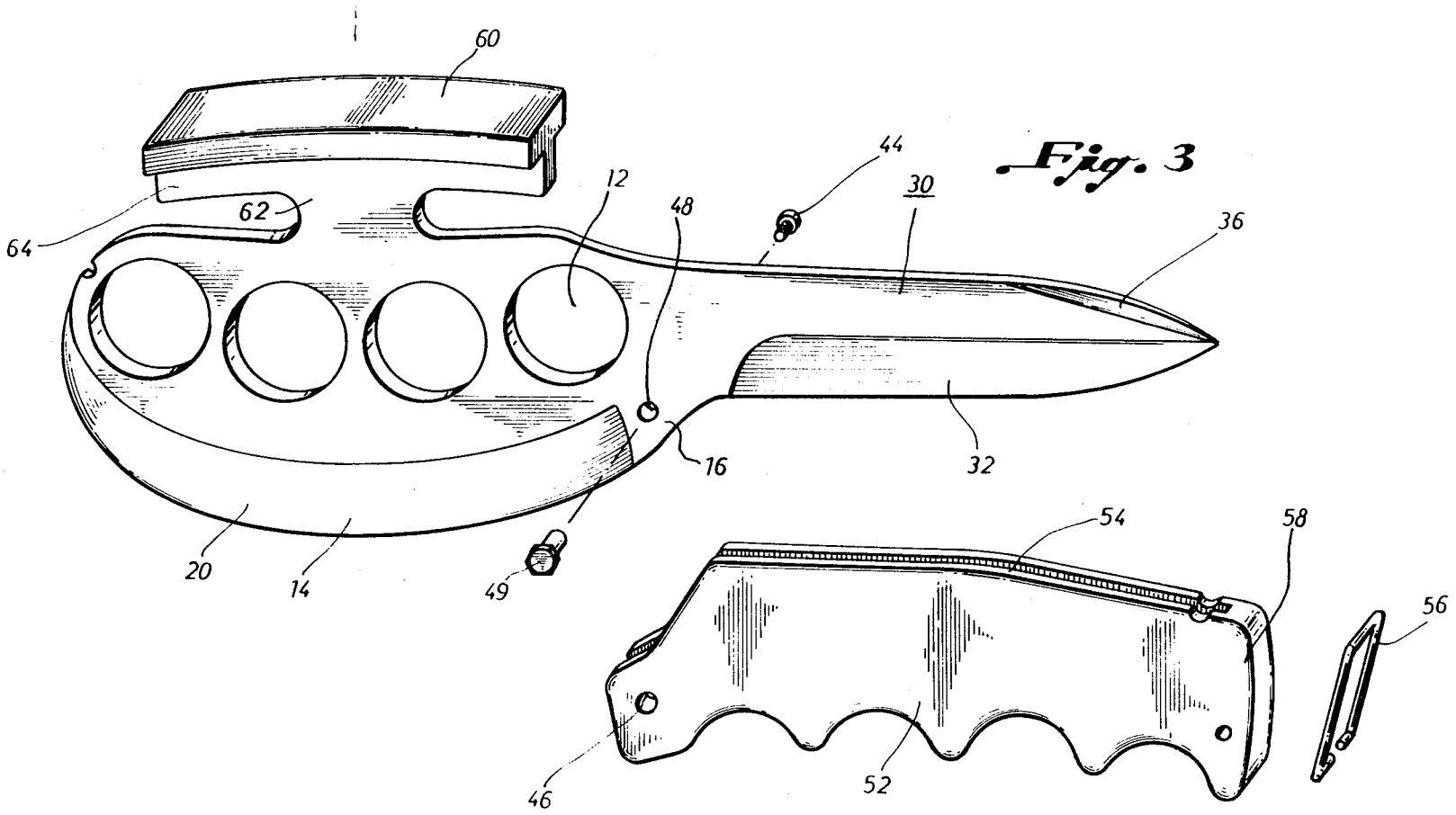
FIG. 3 is a side schematic view of an embodiment of the present invention with the cover detached.

In accordance with the present invention there is generally provided an improved handtool having a body portion such as handle 10, an axe formation such as axe blade 20, a knife formation such as knife blade 30, a cover such as sheath 40 and a hammer formation such as hammer 60. The cover such as sheath 40 is pivotally mounted to the body portion such as main handle 10 such that it is movable between a first position so as to cover a sharpened edge of the knife formation such as knife 30 as shown in FIG. 1 and a second position to cover a cutting surface of the axe formation such as axe 20 as shown in FIG. 2. The body portion such as main handle 10 may be equipped with finger grips such as apertures or holes 12 and the cover such as sheath 40 may also be provided with finger grips such as arcuate surfaces 42 which are alignable with the finger grips on the body portion. The hammer formation such as hammer 60 may be attached to the body portion such as main handle 10 opposite the axe formation. The hammer formation may be made up of a neck portion extending out from the body portion opposite the axe formation and a head portion attached to the neck portion with the head portion being broader than the neck formation so that the hammer formation may also serve as a handle.

Referring now more specifically to FIGS. 1-2, the body portion may be a main handle 10 which is equipped with a plurality of finger grips such as apertures 12. Alternately, the finger grips may be recesses which are cut into the main handle 10. The main handle 10 may be made up of any of a variety of materials including wood, a hard plastic or metal such as steel.

The main handle 10 has a cutting surface 22 along one periphery. The cutting surface or working edge 22 is preferably integrally mounted onto the main handle 10 along interface 14 and constitutes axe portion 20 of the handtool. As shown in the drawings a substantial segment of the working edge 22 of the axe portion 20 is substantially parallel with the longitudinal axis of the main handle 10 such that it extends in a shallow arc along the lower periphery of the main handle 10 for most of its length. Additionally, the cutting edge 22 of axe portion 20 preferably does not extend a substantial distance below the sharpened edge 32 of knife portion 30, thus facilitating the alternate coverage of the cutting edge 22 and the sharpened edge 32. For example, the sharpened edge 32 may be in the form of a shallow arc such as shown in the drawings.

Although the cutting surface 22 of the axe portion 20 preferably does not extend substantially below the sharpened edge 32 of knife portion 30, the axe portion 20 may be of more conventional construction such that the distance between the cutting edge 22 and the interface 24 between the main handle 10 and the axe portion 30 is substantially increased as would be the case if the axe portion 20 was comprised of a hatchet.

As with the main handle 10 the axe portion 20 may be made up of any suitable material, such as steel or other metal, as would be known to one skilled in the art having the benefit of this disclosure. For example, the axe portion 20 and the main handle 10 may both be forged from the same steel piece.

Although the axe portion 20 may vary in configuration, in accordance with the present invention its configuration should be such that it may be covered by the cover such as sheath 40 when the cover is pivoted into the second position for covering the cutting edge 22, for example as shown in FIG. 2.

As shown in the drawings the knife formation such as knife portion 30 comprises an elongated segment extending out of the main handle 10. The knife portion 30 has at least one sharpened edge 32 and is connected to the axe portion 20 through contoured segment 16 of main handle 10. Thus, there is provided a smooth contoured transition between the sharpened edge 32 and the cutting surface 22 which in turn facilitates the pivoted movement of the sheath 40.

The knife portion 30 is preferably equipped with a false edge 36, thus reducing the area of the knife portion 30 to be covered by the sheath 40 and avoiding the need for a covering flap or some type of overlap to ensure complete coverage of any sharpened edges on the knife portion 30. Alternately, if the knife portion 30 is not equipped with a false edge, but rather has another sharpened edge, then the sheath 40 should be equipped with a movable flap or other appropriate mechanism for covering the additional sharpened edge as would be known to one skilled in the art having the benefit of this disclosure.

Any variety of materials may be employed for the knife portion. For example, the knife portion may be comprised of a steel blade. The shape of the knife portion may also be altered. For example, the knife portion may be a larger dagger blade. Alternately, the body portion may be equipped with an appropriate recess and lug to accommodate a bayonet.

The cover such as sheath 40 is pivotally mounted on the main handle 10 so as to be movable between first and second positions. By way of example, as shown in FIGS. 1 and 2 the sheath 40 may be pivotally mounted at the juncture of the main handle 10 and the knife portion 30 near the contoured segment 16 by means of a pivot screw 44 which passes through pivot holes 46 and 48 and is secured by means of pivot nut 49. The sheath 40 is preferably equipped with grooves or recesses indicated generally at 52 and 54. When the sheath 40 is in the first position as shown in FIG. 1 then the sharpened edge 32 of knife portion 30 is covered or cradled by groove or recess 54 in sheath 40. Alternately, when the sheath 40 is pivoted into the second position as shown in FIG. 2 then the cutting edge 22 of axe portion 20 is covered by the groove or recess 52.

Any one of a variety of devices or means may be employed to hold the cover 40 in place when it is in either the first or second positions covering the sharpened edge of the knife formation or the cutting surface of the axe formation, respectively. For example, as shown in FIG. 1 a catch 56 may be employed to hold the sheath 40 in place. Alternately, the configuration of the recess 54 in relation to the knife portion 30 and the type of material used to form the sheath 40 may be such that the sheath 40 tightly fits over the knife portion 30, thus avoiding, at least in some cases the necessity of using a separate catch such as catch 56. Additionally, an edge guard such as internal stop or spacer 58 may be provided depending upon the configuration of and the type of material used for the sheath 40 in order to prevent the sharpened edge 32 of knife portion 30 from piercing the end of the sheath 40. As shown in FIG. 1 the stop 58 may be held in place by cath 56. Alternately, as in much the same fashion as the sheath 40 the internal stop 58 may be configured in relation to the sheath 40 and the knife portion 30 such that it tightly fits on the edge of the knife portion 30, thus in some cases avoiding the necessity of using the catch 56.

As shown in FIG. 2 when the sheath 40 is in the second position the cutting surface 22 of the axe portion 20 of the tool is recessed and hence covered by recessed groove 52. As with the knife portion 30, the sheath 40 may be held in place by means of a catch 59. Alternately, the configuration of the material used in the sheath may be such that the sheath tightly fits over the cutting surface 22 of the axe portion 20, thus avoiding the necessity of using a separate catch or lock in all cases. Additionally, in similar fashion to the knife portion 30 a cutting guard such as an external stop or spacer 57 may be used to prevent penetration of the sheath 40 by the cutting surface 22 of the axe portion 20.

A variety of modifications may be made to the cover such as sheath 40. For example, the edge guard such as internal stop 58 and the cutting guard such as external spacer or stop 57 or both may be made an integral part of the sheath 40. Additionally, the contour of arcuate surfaces 42 may be varied, though they are preferably alignable with the apertures 12 or other finger grips.

The hammer formation such as hammer 60 may take on a variety of configurations. Preferably, the hammer 60 extends from the main handle 10 at a point substantially opposite the axe portion 20 as shown in the drawings. Also as shown in the drawings, the hammer 60 may be provided with a neck portion 62 and a head portion 64 with the neck portion extending out from the main handle opposite the axe portion 20 and with the head portion attached to the neck portion. The head portion 64 is preferably broader than the neck portion so that the upper portions of the main handle 10 and the lower portions of the head portion 64 form spaces 66 such that the hammer portion 60 may serve both as a hammer and as a handle.

The hammer portion 60 may be comprised of a wide variety of materials as would be known to one skilled in the art having the benefit of this disclosure. For example, the neck portion 62 could be comprised of a $\frac{1}{8}$th inch steel blade and the head portion 64 could comprise a steel segment approximately $\frac{5}{8}$ths of an inch wide.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described will be taken as the presently preferred embodiments. Various changes may be made in size, shape and arrangement of the parts and materials. For example, equivalent elements or materials may be substituted for those illustrated and described herein, certain parts may be reversed, and certain features of the invention may be utilized independent of the use of other features, all of which would be apparent to one skilled in the art after having the benefit of this description of the invention.

What is claimed is:

1. A handtool comprising:

a body portion having a cutting surface along one periphery constituting an axe blade formation;

an elongated knife formation extending out of the body portion, said knife formation having at least one sharpened edge; and a cover pivotally mounted on the body portion so as to be movable between first and second positions, said cover having an elongated body with a first recess configured to cover the sharpened edge of the knife formation when the cover is in the first position and a second recess opposite the first recess and configured to cover the cutting surface of the axe formation when the cover is in the second position.

2. A handtool according to claim 1 wherein the cover is pivotally mounted at a point near the juncture of the body portion and the knife formation.

3. A handtool according to claim 1 wherein the axe formation has a contoured extension configured to provide a smooth transition into the sharpened edge of the knife formation.

4. A handtool according to claim 1 wherein the body portion has a plurality of finger grips.

5. A handtool according to claim 4 wherein the cover has a plurality of arcuate surfaces along one edge, said arcuate surfaces being alignable with the finger grips when the cover is in the second position.

6. A handtool according to claim 1 further comprising locks for alternately locking the cover in the first and second positions.

7. A handtool according to claim 1 further comprising an edge guard attachable to the sharpened edge of the knife formation at a point opposite the juncture of the body portion and the knife formation.

8. A handtool according to claim 7 further comprising a catch for holding the edge guard in place.

9. A handtool according to claim 1 further comprising a cutting guard attachable to the cutting edge of the axe formation at a point opposite the juncture of the body portion and the knife formation.

10. A handtool according to claim 9 further comprising a catch for holding the cutting guard in place.

11. A handtool according to claim 1 further comprising a hammer formation extending from the body portion at a point substantially opposite the axe formation.

12. A handtool according to claim 11 wherein the hammer formation comprises a neck portion extending out from the body portion opposite the axe formation and a head portion attached to the neck portion, said head portion being broader than the neck formation so that the hammer formation may also serve as a handle.

13. A handtool according to claim 1 wherein the knife formation has a false edge.

14. A handtool comprising:

a body portion having an axe blade attached thereto, said body portion having a plurality of finger grips;

a knife blade extending from the body portion; and a cover pivotally mounted on the body portion so as to be movable between first and second positions, said cover being configured to cover the knife blade when in the first position and the axe blade when in the second position, said cover also being contoured to be aligned with the finger grips when the cover is in the second position.

15. A handtool comprising:

a body portion having an axe blade attached thereto, a substantial segment of the working edge of the axe blade being in a shallow arc with respect to the longitudinal axis of the body portion and extending a relatively short distance from the body portion;

a knife blade extending from the body portion and substantially along the longitudinal axis of the body portion, said knife blade having a cutting edge on one side and a false edge on the other; and a cover pivotally mounted on the body portion at a point near the juncture of the knife blade and the axe blade so as to be movable between first and second locking positions, said cover having a first recess for covering the cutting edge of the knife blade when the cover is in the first position and a second recess for covering the working edge of the axe blade when it is in the second position.

16. A handtool according to claim 15 wherein the body portion has a plurality of finger holes and wherein the cover is contoured to align with the finger holes when the cover is in the second position.

17. A handtool according to claim 15 further comprising a lock for securing the cover to the body portion when the cover is in the second position.

18. A handtool according to claim 15 further comprising a lock for securing the cover to the knife blade when the cover is in the first position.

19. A handtool comprising:

a blade handle with a knife blade extending therefrom along the central axis of the blade handle, the handle having a plurality of holes extending therethrough;

an axe blade integrally mounted to a lower segment of the handle and having a cutting edge, the cutting edge of said axe blade being sufficiently close to the central axis of the blade handle to facilitate coverage of the axe blade and the knife blade by the same sheath;

a hammer integrally mounted to an upper segment of the blade handle; and a sheath pivotally mounted on the blade handle at a point near the juncture of the handle and the knife blade, said sheath having oppositely positioned grooves contoured to cover the knife blade and the axe blade, respectively.

20. A handtool comprising:

a body portion having a cutting surface along one periphery constituting an axe blade formation and a plurality of finger grips;

an elongated knife formation extending out of the body portion, said knife formation having at least one sharpening edge; and a cover pivotally mounted on the body portion so as to be movable between first and second positions, said cover being configured to cover the sharpened edge of the knife formation when in the first position and the cutting surface of the axe formation when in the second position, the cover also having a plurality of arcuate surfaces along one edge, the arcuate surfaces being alignable with the finger grips when the cover is in the second position.

* * * * *

UNITED STATES PATENT AND TRADEMARK OFFICE

CERTIFICATE OF CORRECTION

PATENT NO. : 4,546,510

DATED : Oct. 15, 1985

INVENTOR(S) : Dan W. Harrison

It is certified that error appears in the above-identified patent and that said Letters Patent are hereby corrected as shown below:

Column 8, line 14, delete "sharpening" and insert therefor --sharpened--.

Signed and Sealed this

*Sixteenth* Day of *September 1986*

[SEAL]

*Attest:*

DONALD J. QUIGG

*Attesting Officer*

*Commissioner of Patents and Trademarks*